United States Patent [19]

Karp

[11] 4,066,988

[45] Jan. 3, 1978

[54] ELECTROMAGNETIC RESONATORS HAVING SLOT-LOCATED SWITCHES FOR TUNING TO DIFFERENT FREQUENCIES

[75] Inventor: Arthur Karp, Palo Alto, Calif.

[73] Assignee: Stanford Research Institute, Menlo Park, Calif.

[21] Appl. No.: 720,556

[22] Filed: Sept. 7, 1976

[51] Int. Cl.[2] ..... H01P 7/04; H01P 7/06; H01P 1/20

[52] U.S. Cl. ..... 333/82 B; 333/73 C; 333/73 W; 333/83 R; 334/41

[58] Field of Search ..... 333/31 R, 31 A, 73 C, 333/73 W, 82 A, 82 B, 83 R; 331/96, 101; 334/41, 42

[56] References Cited

U.S. PATENT DOCUMENTS

| | | | |
|---|---|---|---|
| 3,290,624 | 12/1966 | Hines | 333/31 A |
| 3,546,633 | 12/1970 | Peppiatt | 333/73 W X |

*Primary Examiner*—Paul L. Gensler
*Attorney, Agent, or Firm*—Lindenberg, Freilich, Wasserman, Rosen & Fernandez

[57] ABSTRACT

In a waveguide resonator, either coaxial or noncoaxial, there are inserted spaced slots which establish inductances in series with the waveguide structure at the location of each slot. These slots tune the resonance of the waveguide cavity, which would generally be used in a bandpass filter. Switch means are provided for each slot for discretely altering the value of the inductance established, whereby the resonator or filter may be tuned to a large number of different frequencies.

15 Claims, 18 Drawing Figures

ELECTROMAGNETIC RESONATORS HAVING SLOT-LOCATED SWITCHES FOR TUNING TO DIFFERENT FREQUENCIES

ORIGIN OF THE INVENTION

The invention herein described was made in the course of or under a contract or subcontract thereunder, (or grant) with the Department of the Air Force. This requirement falls under ASPR 7-302.23 (b) (j) (2) (ii).

BACKGROUND OF THE INVENTION

This invention relates to electronically tuned filters, and more particularly to improvements therein.

In a U.S. Pat. No. 3,811,101 there is described an electronically tunable waveguide resonator in which spaced irises are inserted to establish two capacitances in series at each iris location, together with switch means in the form of PIN diodes for selectively shorting out one of the series connected capacitances, whereby tuning may be accomplished. Since the tunable resonator is loaded with shunt capacitances (between the two conductors of the transmission line) each of which is in series with a PIN diode, the RF peak power rating of the resonator is established by the RF voltage allowable across the back biased diodes in the most significant tuning iris. This allowable voltage depends on the thickness of the I layer in the junction and also on the nature of the passivation used on the surface of the semiconductor die. From the highest-rated diodes in production, a selection might be made permitting application of zero-to-peak voltages in the range 700 to 1000 volts.

In order to increase the peak power rating of the resonator, a series string of PIN diodes, such as three, can be used to triple the reverse voltage ratings, (bias, zero to peak RF, and reverse breakdown) and roughly one order of magnitude increase in RF power rating of the resonator should result. Of course each diode in the string requires a heat sink (two of them electrically insulating) along with low-inductance interconnecting straps and bleeder resistors must be included to assure equal division of the bias voltage applied to the diodes. This approach for increasing RF power rating is straight forward, but costly, because of the extra components and intricate assembly work required.

Using the above techniques, it might be possible to raise the RF power rating to the order of 1 K.W. However, the total reverse bias voltage for the diode string associated with the most significant tuning iris would be on the order of 3000 volts, and the required high-switching-speed, solid-state, control system would be very difficult to realize.

OBJECTS AND SUMMARY OF THE INVENTION

An object of this invention is the provision of a novel construction for affording electronic tuning of a high power VHF, UHF or microwave resonator used as a bandpass or other filter.

Still another object of this invention is the provision of a higher-RF-POWER, tunable, microwave resonator than heretofore, yet having a simple construction.

Yet another object of this invention is the provision of a tunable VHF/UHF/microwave resonator which provides a higher RF power rating than heretofore, yet is still relatively economical to construct.

A further object of this invention is a construction for affording electronic tuning of a microwave resonator which affords a less expensive tuning arrangement than heretofore required for devices of this type.

The foregoing and other objects of the invention may be achieved in a waveguide which is distributively loaded with several identical, but independent, inductive slots. Switches are connected across these slots which are operable to enable the effective inductance of a slot to be altered from one discrete value to another to thereby tune the filter resonator to be responsive to different frequencies. Additionally, the distribution for the slots may be determined such that the tuning increment resulting from the switching of each member of the series of slots is related very closely in a binary manner.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
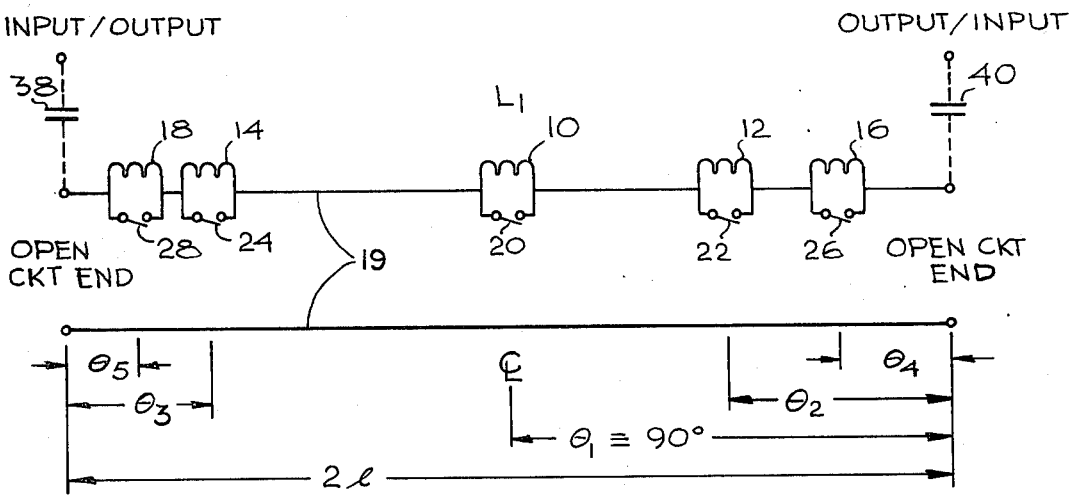
FIG. 1 is a schematic representation of a band pass filter resonator, in accordance with this invention, which is operated in a half wave mode with an open circuit at both ends.

FIG. 1 illustrates schematically, the equivalent circuit of a transmission line (generally coaxial) resonator, open circuited at both ends, distributively loaded with independent switch-controlled inductive slots in accordance with this invention. As will be seen in later drawings, each slot, here represented by inductors 10, 12, 14, 16, 18 is cut into one or the other or both of the conductors 19 of a TEM-line, or into either or both of the broad walls of a waveguide, and thereby establishes an inductance, designated as $L_1$, in series with the conductor. All of the inductances, $L_1$, effectively are distributed along the length of the transmission line and separated by distances that are significant fractions of a wavelength. The logic behind the distribution selected is explained subsequently herein. Independent switches respectively 20, 22, 24, 26 and 28 are connected for selectively short-circuiting, or at least greatly reducing each one of the $L_1$ inductances.

Figure 1A:
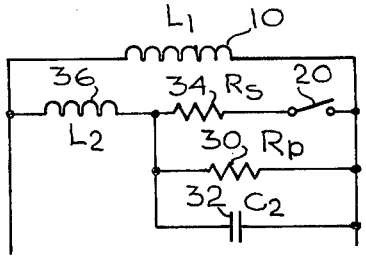
FIG. 1A is a representation of the circuit established by an inductive slot and diode switch.

In the case where the switches are PIN diodes, a biasing adjunct, such as a choke, (not shown), is needed for each switch. As will be seen later, a biasing adjunct may be devised that has negligible loading effect on the RF circuit elements. The switch itself, however, is not a perfect "open" or "short circuit". FIG. 1A illustrates the parasitic resistances and reactances of each switch. These are not shown elsewhere to preserve simplicity in the drawings. The resistance 30 and capacitance 32 represent a "switch open" equivalent resistance $R_p$, and capacitance, $C_2$. The resistance 34 and inductance 36 represent the "switch closed" equivalent resistance, $R_s$, and inductance, $L_2$.

Means for coupling to external circuits is represented by capacitors 38 and 40 located at both ends of the resonator.

With all the slots essentially shorted out at the entrances thereto the fundamental resonant frequency $f_0$ of the transmission line resonator shown in FIG. 1 is $c/4l$ where $c$ is the phase velocity of the waveguide and $l$ is the cavity half length. The mid-plane of the waveguide exhibits a zero of (transverse) electric field and a maximum of (longitudinal) wall current. The ends exhibit maxima of electric field and a zero of wall current.

The inductive slots in FIG. 1 which become effective upon opening the switches are identified according to their distance from the nearest zero (or node) of RF current (or maximum or anti-node of electric field).

It is convenient to specify the distances $\theta$ as "electrical angles" relative to $\theta_1$ (distance from open to mid plane) being defined as 90°. That is, as shown on the drawing, the most-significant slot is associated with an RF current anti-node (or electric-field node) and is a distance $\theta_1$, or 90° from an RF current node of the waveguide. A slot is considered to be more or less "significant" to the resonator as $\theta$ is larger or smaller.

The principal inductance provided by the slot is $L_1$. Since, when "open", the switch exhibits a small capacitive susceptance proportional to $C_2$, it is necessary to increase the inductive susceptance of the slot (inversely proportional to $L_1$) slightly to neutralize the capacitive susceptance mentioned. It is assumed that the value of $L_1$ as used in this document already reflects a value corrected for a finite $C_2$. When the switch is "closed", it exhibits a small inductance, $L_2$. However, it is current practice to fabricate PIN-diode switches by sandwiching the semi-conductor "chip" between very short, fat posts; thus $L_2$ is effectively negligible if connections to the diode are made very close to the "chip". The effective slot inductance is thus two valued:

$$L \max \approx L_1 \text{ with switch open.}$$

$$L \min \approx 0 \text{ with switch closed.}$$

Having all the slots identical has many advantages such as allowing one to optimize the one configuration. The significance of a slot for tuning purposes is then determined solely by its location relative to the RF current nodes and anti-nodes in the main cavity. A slot inductor located at a distance from the RF current maximum is the effective equivalent of an inductor of lower value located right at the maximum. To a very good approximation (which is all the more valid if the loading of the main resonator by the slots may be said to be "light" and if the slots do not interact with one another) the equivalence factors are $\sin^2\theta_i$, where $i = 1, 2, 3, \ldots, N$. That is, a localized inductance located at $\theta=\theta_i$ has about the same effect on the circuit as an inductance $\sin^2\theta_i$ times are large, located at $\theta=90°$. Thus, a binary tuning program will be achieved if:

$$\sin^2\theta_i = 1, \tfrac{1}{2}, \tfrac{1}{4}, \tfrac{1}{8}, \ldots, 2^{1-N}.$$

It is also assumed that the overall percentage tuning range is relatively small, i.e., less than half an octave. The tuning range is defined by its two end frequencies, which correspond to cavity resonance with all switches open and cavity resonance with all switches closed. The following table is derived from the last equation.

SLOT PLACEMENT FOR A BINARY TUNING PROGRAM

| SLOT No. (i=) | NOMINAL "FREQUENCY TUNING EFFECT" | $\sin^2\theta_i$ | $\theta_i$ | DISTANCE FROM CURRENT NODE |
|---|---|---|---|---|
| 1 | 1/2 of the tuning range | 1 | 90° | 1 |
| 2 | 1/4 of the tuning range | 1/2 | 45° | 0.500 l |
| 3 | 1/8 of the tuning range | 1/4 | 30° | 0.333 l |
| 4 | 1/16 of the tuning range | 1/8 | 20.7° | 0.230 l |
| 5 | 1/32 of the tuning range | 1/16 | 14.5° | 0.161 l |
| . | . | . | . | . |
| . | . | . | . | . |
| N | $1/2^N$ of the tuning range | $1/2^{N-1}$ | $\sin^{-1}\left[2-\frac{(N-1)}{2}\right]$ | $2\theta_i l/\pi$ |

The derivation leading to the table has involved approximations. Nevertheless, it has in practice provided the desired results. The resonator described herein, which is tuned by two-valved inductive slots that are in series with the transmission line, is an electromagnetic dual of the resonator described in U.S. Pat. No. 3,811,101, which is tuned by two-valued capacitive irises that shunt the transmission line. For that case, computer modeling as well as experimental working models, based on $N=5$, have shown that when the table is followed, the desired binary tuning logic results, as evidenced by a substantially uniform spacing of 32 resonances over a tuning range of 21%, for example, when the switches of the 5 irises are operated in all possible combinations.

The locations of the slots may be determined as those which satisfy the following relationship:

$$\sin^2 \frac{\pi l_1}{2l} = 2\sin^2 \frac{\pi l_2}{2l} = 4\sin^2 \frac{\pi l_3}{2l} = 8\sin^2 \frac{\pi l_4}{2l} = \ldots = 2^{N-1} \sin^2 \frac{\pi l_N}{2l}$$

where $l_1, l_2, l_3, l_4, \ldots, l_N$ are each locations of a slot measured from a current node of the unloaded waveguide, and $l$ is the distance from a current node to current anti-node in the unloaded waveguide.

Figure 2:
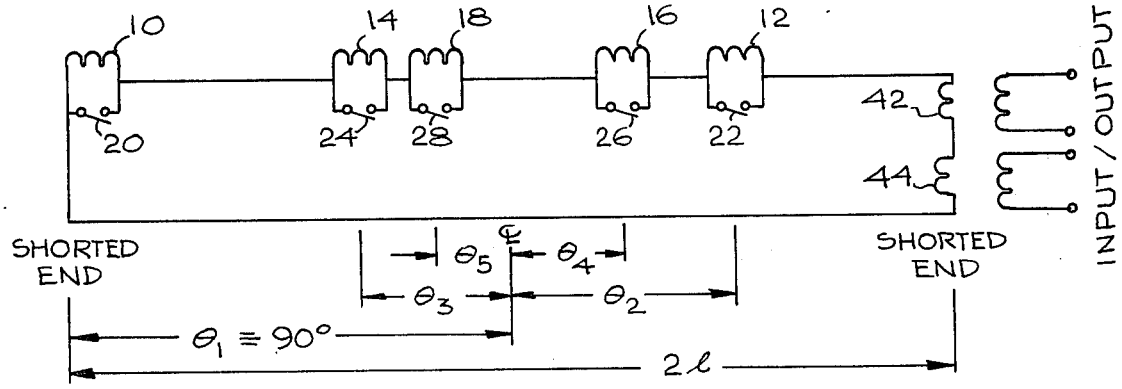
FIG. 2 is a schematic representation of a band pass filter resonator, in accordance with this invention, which is operated in a half wave mode with a short circuit at both ends.

FIG. 2 is a schematic representation of a half wave resonator with a short circuit at both ends. Slot placement of slots 10 through 18 is shown to achieve the same tuning effects as are achieved with the slot placement in the resonator shown in FIG. 1, and to assist in identifying slots and switches which provide similar tuning effects, the same reference numerals are used in both figures. Two coupling loops 42, 44 are shown at one shorted end illustrative of input and output means.

Here again, the fundamental resonant frequency, $f_0$, of the transmission line resonator is $c/4l$. The (transverse) electric field in the resonator has a half sine wave distribution with a maximum in the mid plane. The (longitudinal) wall currents are then zero in the mid plane and maximum at the ends.

Figure 3:
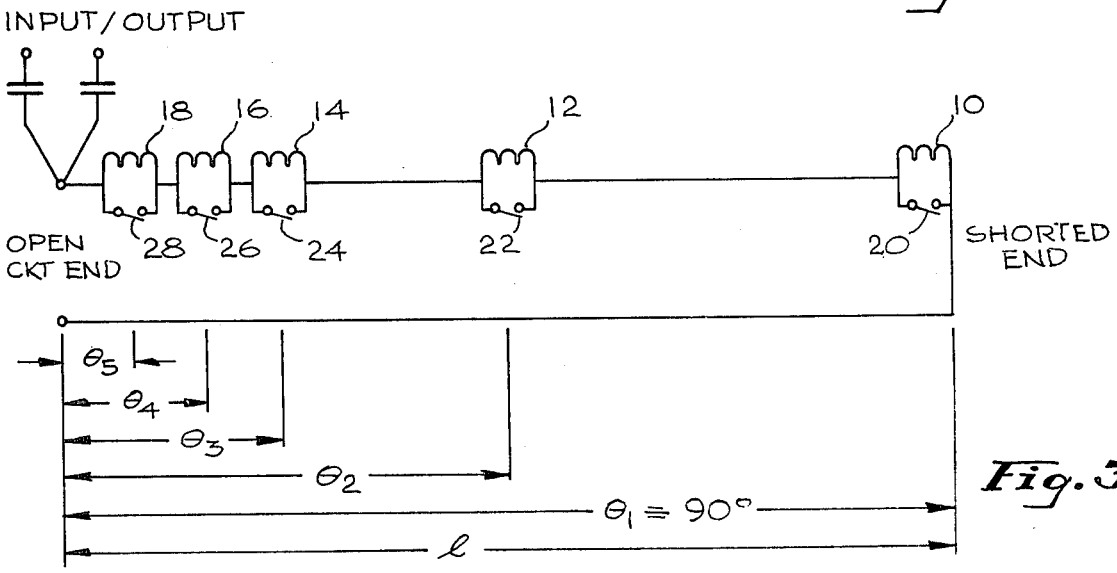
FIG. 3 is a schematic representation of a band pass filter resonator, in accordance with this invention, which is operated in a quarter wave mode with an open circuit at one end and a short circuit at the other end.

FIG. 3 is the equivalent circuit of a transmission line resonator which is shorter than those discussed so far because it is quarter-wave resonant, having one end open-circuited and the other end short-circuited. The slots and switches are given the same reference numerals as slots and switches in the previous drawings which provide substantially the same tuning effects. Here $\theta$ is measured from the open circuit end. The location of the slots may be determined as those which satisfy equation 1, where $l_1, l_2 \ldots l_N$ are each locations of a slot measured from the open circuited end of the waveguide, and the length $l$ is the distance from open to short circuited end of the waveguide, when it is operated at quarter wavelength resonance.

Figure 4:
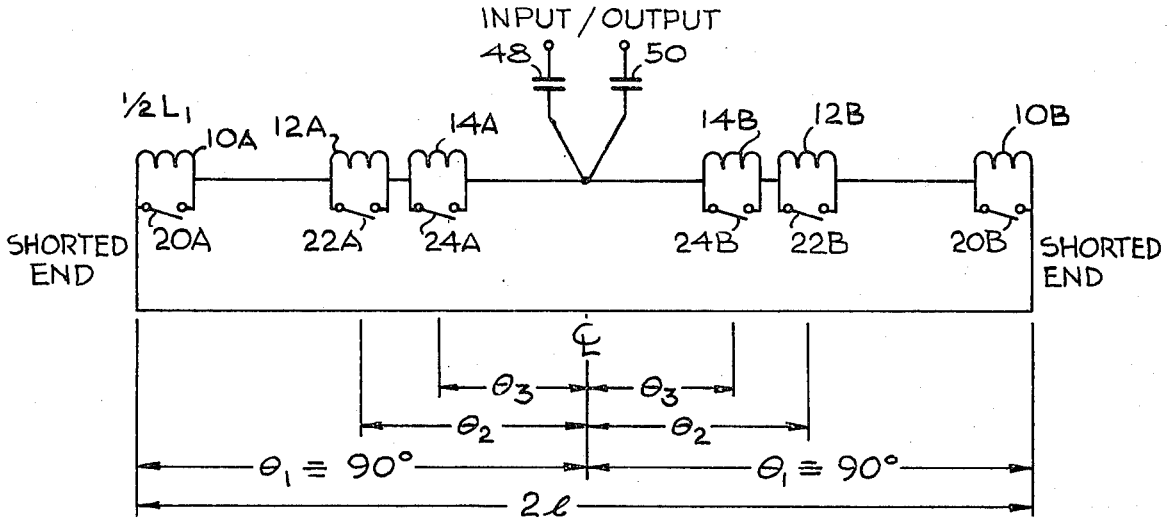
FIG. 4 is a schematic representation of a band pass filter resonator, in accordance with this invention, which is operated in a half wave mode with a short circuit at both ends and with tuning slots halved and dispersed.

FIG. 4 illustrates a half wave resonator with shorted ends, such as is shown in FIG. 2. However, each tuning slot inductance, such as 14, is now in two parts, 14A, 14B. Only three of the five tuning inductances and their associated switches shown in FIG. 2, are shown as an example. These are inductances 10A,10B, 12A,12B, 14A and 14B and the associated switches 20A,20B,-22A,22B,24A and 24B. Each half of a slot inductance is placed equidistant from the center of the waveguide. Input and output may be taken from the midpoint of the waveguide by capacitive means 48, 50, for example.

A choice as to which of the several embodiments is to be used depends upon the particular application to be served and the frequencies of interest. However, the resonator arrangement shown in FIG. 3 is less advantageous at higher frequencies than the one shown in FIG. 2, for example, due to the mechanical inconvenience of having slots closer together in the embodiment of FIG. 3 and the greater likelihood of unwanted interactions between the slots.

Figure 5:
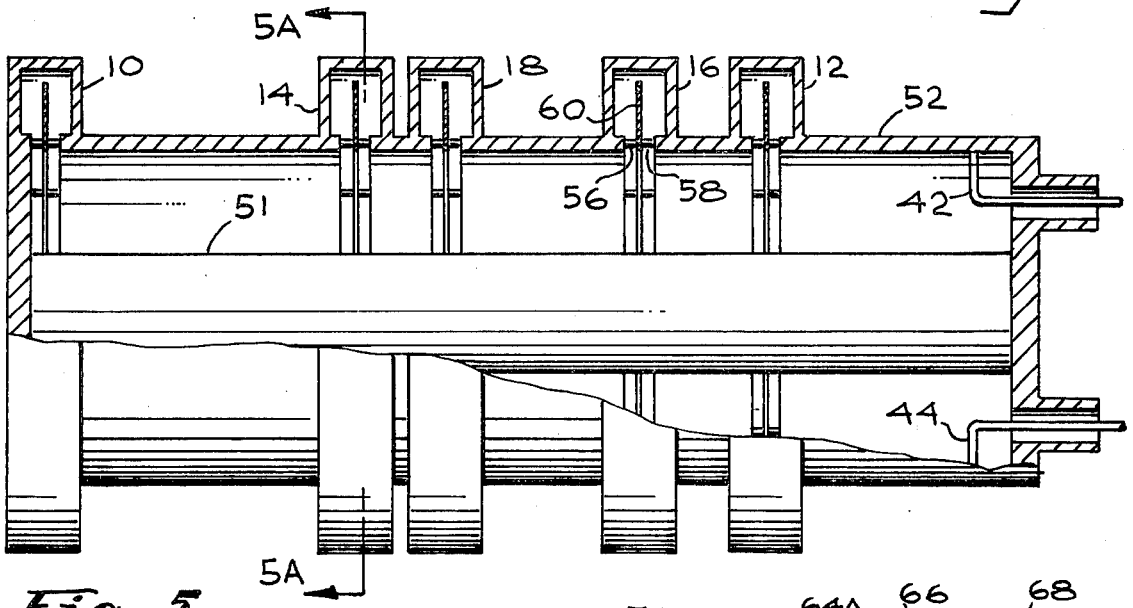
FIG. 5 is a cross sectional view illustrating the construction, in accordance with this invention, of a tunable half wave resonator with both ends short circuited.
Figure 5A:
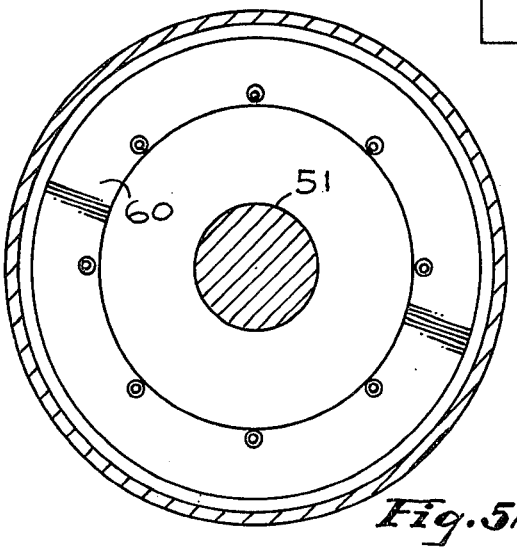
FIG. 5A is a transverse view along the lines 5A—5A on FIG. 5.
Figure 6:
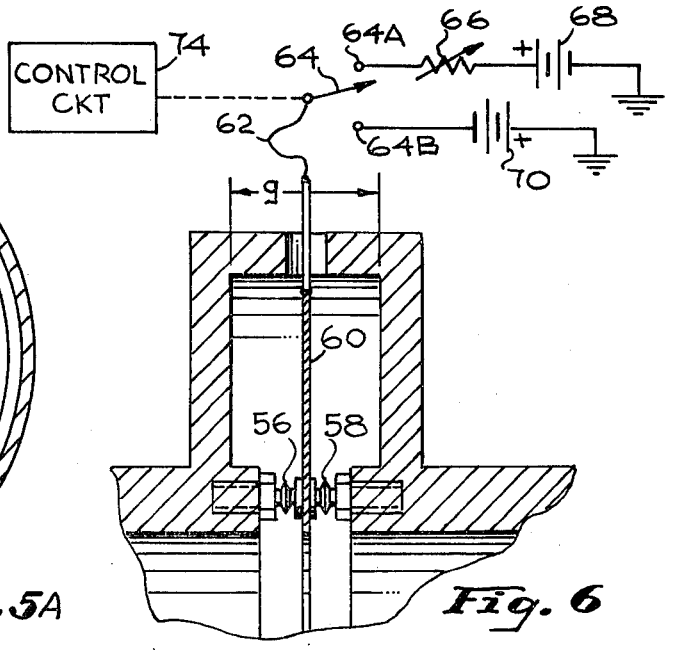
FIG. 6 is a cross sectional view illustrating the detail of a tuning slot.

Reference is now made to FIG. 5, which is a longitudinal cross section of an embodiment of the invention, FIG. 5A, which is a transverse section taken along the lines 5A—5A in FIG. 5, and FIG. 6, which illustrates enlarged and in cross section the structure at one of the slots in FIG. 5. The embodiment of the invention illustrated in FIG. 5 corresponds to the schematically illustrated embodiment in FIG. 2, namely a half-wave resonator with a short circuit at both ends. The half-wave resonator is a coaxial resonator with a center conductor 51, and an outer cylindrical wall 52. Pick up loops for input and output respectively 42, 44, are provided at one end, as represented in FIG. 2. The slots respectively 10–18 are formed by cutting circumferential openings in the outer wall of 52 and bridging these openings with what may be called a hollow toroid or annular trench, with one side opening into the opening in the coaxial outer wall 52. These hollow volumes are placed along the coaxial resonator at the same locations as are shown in FIG. 2, to provide binary tuning.

To accomplish the switching functions, PIN diodes, respectively 56, 58 in FIGS. 5 and 6, are used. These switches effectively block or pass the entrance of electromagnetic energy into the trench-like region. Since the trench runs completely around the coaxial resonator, it is necessary to distribute the diodes around the circular trench. At least three points (equally spaced) around the circular trench or slot should be occupied by diodes, but preferentially, more should be used. In FIG. 5A, eight of these are shown. All of the electronic switches around a trench entrance are in parallel with regard to the RF electrical circuit. In addition, as shown in FIG. 6, at each location it is necessary that each switch be comprised of two diodes "nose to nose" (56, 58), which is done to facilitate the application of bias to the diodes.

Each pair of diodes has their anodes connected together at the center of a trench entrance and the cathodic heat sinks are connected to opposite sides of the entrance to the trench. Both anodes, which meet the midplane of the trench, are connected to a thin metal circular disc 60, to the periphery of which, at one or more points, through a suitable opening in the hollow toroid wall, a wire 62 is connected. The wire 62 connects to a selector switch 64. Switch 64 has two terminals respectively 64A,64B. Terminal 64A connects through a variable resistor 66 to a positive bias source 68. Terminal 64B connects to a negative bias source 70. Each switch 64 may be connected to a switch control circuit 74, which permits binary control of the arrangement.

Each pair of diodes is biased in parallel by the arrangement just described, whereas with respect to RF voltages and currents at the mouth of the trench the members of the pair are in series. The thin metal disc or septum, that is common to all of the diode-pair midpoints, lies in an equipotential plane of the E-field associated with the trench and therefore if it remains thin will not perturb the electromagnetic fields of the trench. Bias voltage or current is applied to the septum, relative to ground by means of a wire, as shown, which also does not affect the RF fields or currents. Here there is simply and automatically provided a negligible interaction between the bias means and the RF circuit parts and the RF fields and currents.

A high negative bias voltage applied to the anodes (with negligible current flowing) "opens" the switches, while a high positive bias current (at a potential around 1 volt) "closes" the switches.

Figure 7:
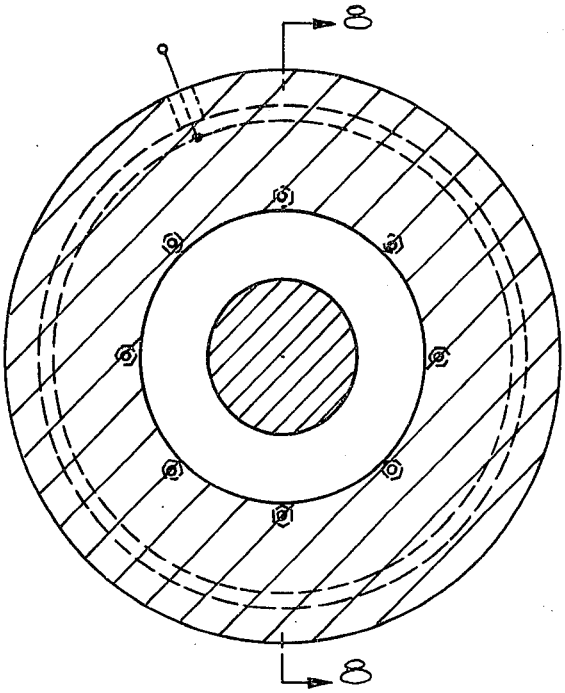
FIG. 7 is a transverse section of a coaxial line, with slots in the outer wall, constructed in accordance with this invention.
Figure 8:
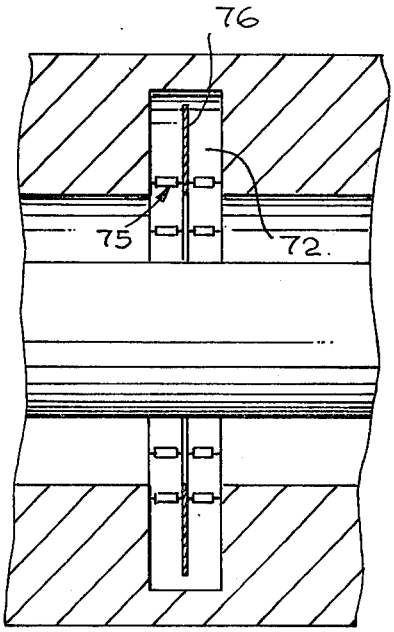
FIG. 8 is a longitudinal section taken along the lines 8—8 in FIG. 7.

FIG. 7 is a transverse section of a coaxial resonator and FIG. 8 is a longitudinal section along the lines 8—8 of FIG. 7, which illustrate how the slots and switches may be assembled from within the outer wall of the resonator instead of being built on the outer wall of the resonator as shown in FIG. 6. The trench-like slots 72, are cut into the outer wall inside of the resonator. The diode pairs, 75, are spaced equally around each slot. They have their anodes connected to a septum 76 whereby the diodes may be biased.

Figure 9:
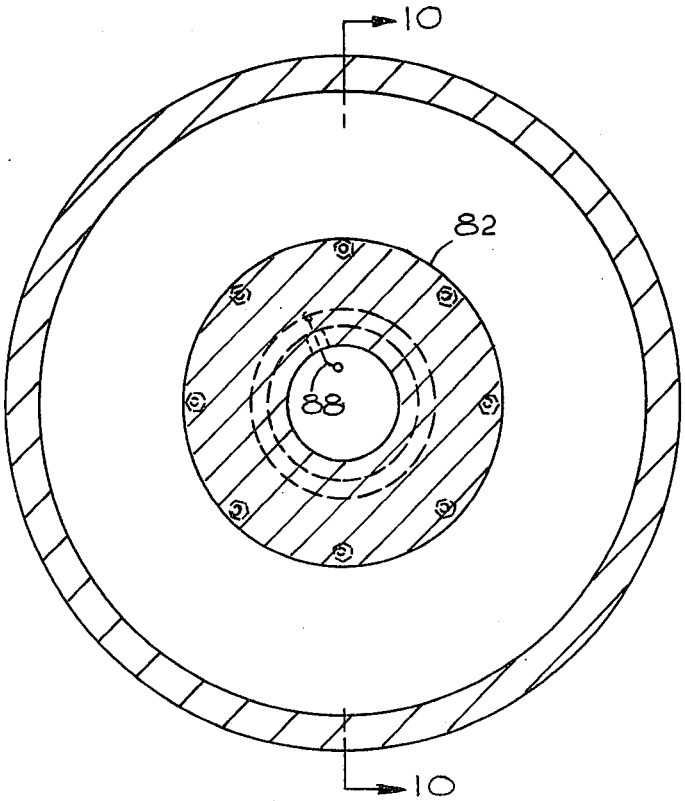
FIG. 9 is a transverse section of a coaxial line, with slots in the inner conductor constructed in accordance with this invention.
Figure 10:
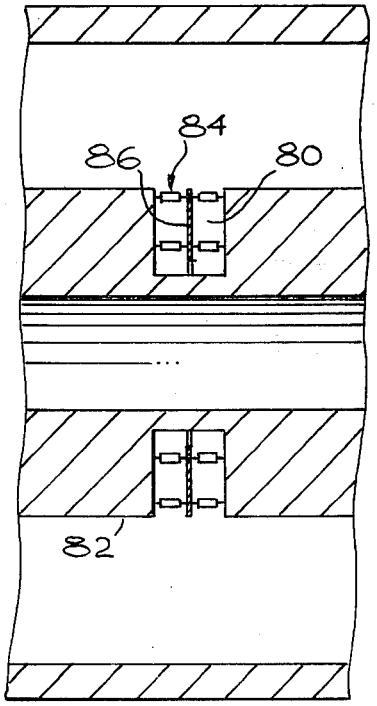
FIG. 10 is a longitudinal section taken along the lines 10—10 in FIG. 9.

FIG. 9 is a transverse section of a coaxial line resonator and FIG. 10 is a longitudinal section taken along the lines 10—10 of FIG. 9, which show how the slots and diode switches may also be provided within the inner conductor of the coaxial line. Here, the slot 80, constitutes a circular trench cut into the inner conductor 82 of the coaxial line. The diode pairs 84 are mounted at the entrance to the trench with their two cathodes connected to the inner conductor 82 and their anodes connected to a septum 86 which extends inwardly toward the center of the central conductor 82. The center of the central conductor is hollow and a hole is cut at one point through the central conductor to permit passage for a bias wire, 88 to connect to the septum 86. All of the bias leads are connected to the external switches and power supplies through the hollow center of the central conductor 82.

It should be clear to those skilled in this art that from the foregoing description, a combination of the slot placements may be used in a single coaxial line, that is, slots may be placed in both outer and inner conductors if that construction provides more convenience for a particular situation. Such a construction is considered within the scope of the claims herein.

The number of diodes to be used is determined by considerations of the resonator Q, as influenced by diode losses when "closed", (forward bias) and when "open" (reverse bias). In the former case, having more diodes in parallel reduces the loss but in the latter case it increases the loss. A compromise is therefore made so that the two situations will yield about the same net loss. This is necessary because in general some of the slots in the filter will have forward-biased diodes at the same time as other slots have reverse-biased diodes. It may also be noted that if too few diodes are used in parallel, the resonator tuning plan and resonator Q may be adversely affected by switch self inductances and RF current crowding problems. In the UHF resonator being discussed, as an illustrative embodiment of the invention, and using the diodes mentioned, six to eight pairs of diodes per slot may provide a substantially correct balance.

Figure 11:
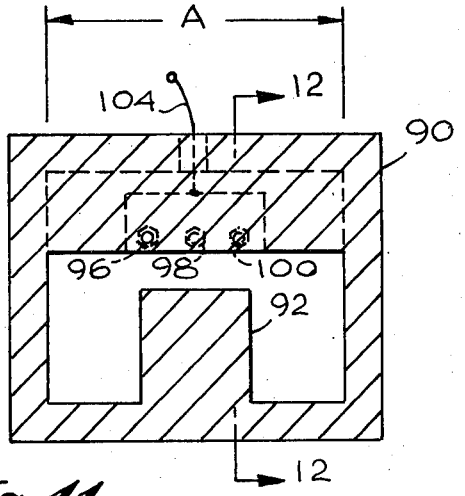
FIG. 11 is a transverse section of a ridged rectangular wave guide illustrating slots placed in the broad wall.
Figure 12:
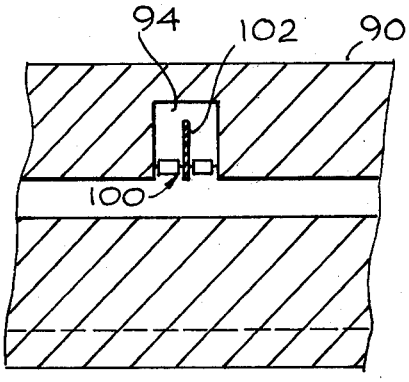
FIG. 12 is a view along the lines 12—12 of FIG. 11.

FIGS. 11 and 12 are respectively transverse and longitudinal sections of a rectangular wave guide 90, having a ridge 92 therein. Slots such as 94, are spaced along the upper wall at locations which are determined in the same manner as for the embodiments of the invention previously described. Each slot has a width A, which is larger than the width of the ridge and preferably greater than a half wavelength. As shown in FIG. 11, three diode pairs, respectively 96, 98 and 100 are placed in a slot. A greater or lesser number of diodes may be used. These diode pairs are connected to a septum 102, in the manner previously described. A hole may be drilled through the top wall of the ridged wave guide to permit a bias lead 104 to be connected to the septum.

If there were no ridge in the wave guide, the slot and diode arrangement shown in FIGS. 11 and 12 could still be used for tuning the rectangular waveguide resonator.

Figure 13:
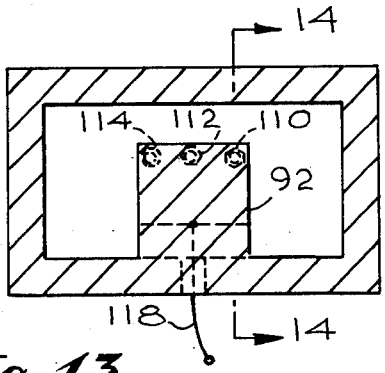
FIG. 13 is a transverse section of a ridged rectangular wave guide illustrating slots placed in the ridge.
Figure 14:
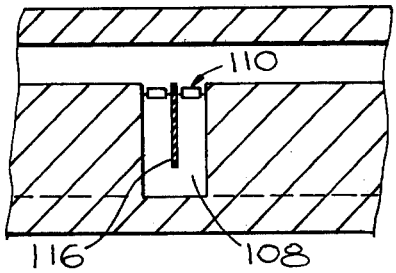
FIG. 14 is a view along the lines 14—14 of FIG. 13.

FIGS. 13 and 14 are respectively transverse and longitudinal sections of a rectangular wave guide of the type shown in FIG. 11, illustrating placement of the slots 108 and diode pairs respectively, 110, 112, 114, in the ridge 92, of the ridged wave guide. The slot is cut across the ridge and the spacing of the slots are determined in the same manner as for the previously described coaxial resonators. The diode pairs are connected to a septum 116. A hole is drilled in the bottom wall of the ridged wave guide and a bias lead 118 is connected to the septum.

Figure 15:
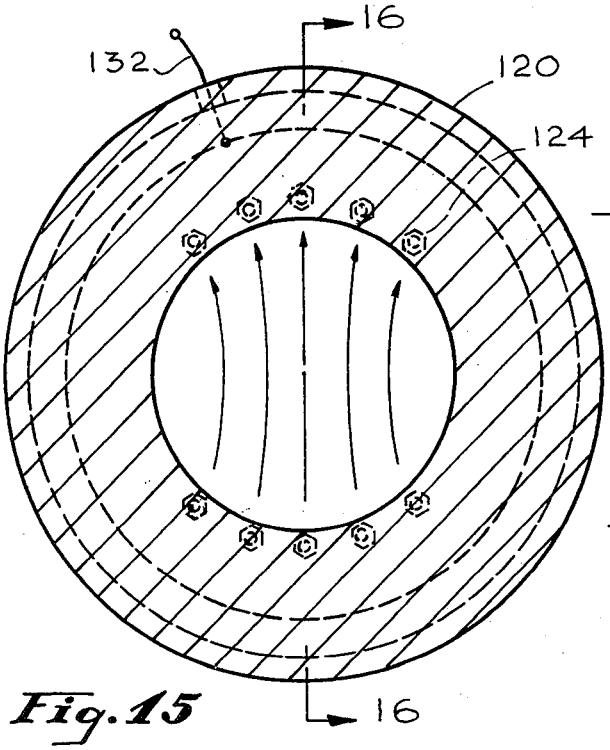
FIG. 15 is a transverse section of a circular wave guide to be operated in the $TE^{\circ}_{11}$-mode, with the E-field vertical, with slots placed therein in accordance with this invention.
Figure 16:
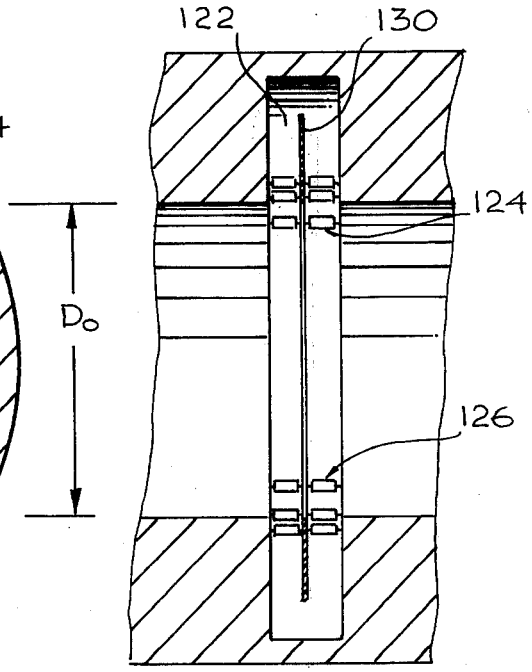
FIG. 16 is a longitudinal section along the lines 16—16 of FIG. 15.

FIGS. 15 and 16 are respectively transverse and longitudinal sections of a circular wave guide 120. The spacing of slots along the length of the circular wave guide is done in the same manner as has been described for previous embodiments of the invention. Here, the slot is made within the wall of the wave guide and is also circular. Diode pairs such as 124, 126 are connected across the mounth of the slot 122. The representation in FIG. 15 of arrows within the cavity of the circular wave guide is to illustrate that the exitation of the circular wave guide is in the $TE^{\circ}_{11}$ mode with E-field vertical. The diode pair placement may also be considered vertical. For every diode pair placed within the notch at the top of the wave guide a diode pair is placed equally and oppositely at the bottom of the wave guide in the notch. Thus, five diode pairs commencing with 124 are shown placed at the top of the wave guide and 5 diode pairs are placed at the bottom of the wave guide with these same spacing from each other as the spacing between the diode piars at the top of the wave guide. The circular septum 130 is connected to the anodes of all of the diode pairs. An opening is made in the wall of the wave guide through which a bias lead 132 is inserted to connect to the septum.

Where a coaxial (cylindrical) transmission line is being used for the basic resonator cavity, the slots (or trenches) become radial transmission lines either extending outward from the outer conductor of the coaxial transmission line (FIGS. 5, 7, 8) or else inward from the inner conductor (FIGS. 9, 10). One diameter of the radial line is the entrance diameter; the other diameter where the radial line ends (which is larger in the first case and smaller in the second case) specifies a short circuit wall. The dimensions used can be determined from the following: The inductance provided by the radial line (as "seen" at its entrance) is directly proportional to the gap height (g in FIG. 6) and inversely proportional to the entrance circumference.

The inductance (actually the inductive reactance) also depends on the entrance diameter, the "shorted" diameter and the wavelength, according to relationships given in textbook writings, such as Article 9.08 (pp. 354–360) of "Fields and Waves in Modern Radio" by S. Ramo and J. R. Whinnery, New York, John Wiley & Sons Inc., First Edition, 1944. The dimension g should be as large as room permits; the entrance diameter has been previously indicated, so the diameter where the radial line ends becomes as indicated by the equations or graphs in the indicated book.

From the foregoing, it should be apparent that the invention comprising slots and switches in the form of diodes may be used with all types of transmission lines. The inductive tuning slots and switches may be located in one or both walls of a guide or in one or both of the ridges of ridged guides. Asymmetrical cross sectional guides should not be excluded from the scope of this invention.

It has been found that after five or six slots have been installed in a UHF filter, the spacing between slots or between a slot and a coupling probe, or between a slot and the open circuit end of a resonator, starts to become inconveniently small. Hence, if the tuning range is required to be divided into more than 32 or 64 parts, more slots must be added, though not very many, since the number of tuning channels doubles for each additional slot.

The solution is to begin a second series of "fine tuning" slots. If the tuning effectiveness of a first fine tuning slot is 1/32 of that of a first coarse tuning slot, and if there is negligible interaction between them, then successive halvings of tuning increments by each slot in turn would be continued from the five coarse to the five fine tuning slots, whereby a total of 1024 resonances can be made available, assuming one chooses five members in each set. (In practice one may expect five slots in a coarse set, but only 2 in a fine set, giving the resonator 128 resonances or channels).

A fine tuning slot is so called, because the tuning increment that it is switching in or out is less than that of any of the "coarse-tuning" slots distributed throughout the resonator. The entire set of fine tuning slots forms a secondary set of binary tuning increments.

For example, if the tuning increments provided by the coarse tuning sets are $\frac{1}{2}$, $\frac{1}{4}$, $\frac{1}{8}$, 1/16 and 1/32 of the tuning range, then the tuning increments of the fine tuning set are 1/64, 1/128, 1/256, 1/512, and 1/1024 of the tuning range.

The fine tuning slots should not be located too near a coarse tuning slot, to minimize interaction. At the same time, the location of the fine tuning slots sets should also satisfy the relationship $$\sin^2 \frac{\pi l_1^1}{2l} = 2\sin^2 \frac{\pi l_2^1}{2l} = 4\sin^2 \frac{\pi l_3^1}{2l} = \ldots$$

where $l_1'$, $l_2'$, . . . are each locations of a fine tuning slot measured from a current node of the wave guide, and $l$ is as defined before.

In the resonator exemplification illustrated in FIG. 1 of the drawings, the first of the fine tuning inductive slots, for example, may be located substantially midway between the coarse tuning slots 10 and 12. By using the equation provided in the preceding paragraph one can determine the distance $l_2'$ to find the correct location for the second fine-tuning slot, which is in the region between the coarse tuning slots 10 and 14, but closer to 14. From the foregoing, it should be obvious how to locate any remaining fine tuning slots.

In the embodiment of the invention which is illustrated in FIG. 2, the first fine-tuning slot may be placed about one-half way between the right hand end of the cavity and coarse tuning slot 12. The second fine tuning slot may be placed between coarse tuning slots 10 and 14, but closer to 14. From this it should be obvious how to determine the location of any remaining fine tuning slots.

The design of a fine-tuning inductive slot can be similar to that of a coarse-tuning inductive slot, only much shallower, and perhaps with fewer diodes. Or, a fine tuning slot in a circular transmission-line conductor, if desired, need not go completely around the circumference of the conductor. It may be a localized indentation of the cavity wall, bridged across by a single pair of diodes. Any asymmetry which results will have a negligible affect on the Q or bandwidth of the resonator as a whole, since this fine tuning inductive slot function is only used to introduce a very small resonator frequency shift (typically 0.2 to 0.3 of 1% at most).

Fine tuning may also be accomplished by fine-tuning shunt-capacitive irises as employed under U.S. Pat. No. 3,811,101. The resulting resonator is then a hybrid, using series-inductive slots for coarse tuning and shunt-capacitve irises for fine tuning. In this instance, the frequency shifts caused by the opening or closing of a switch are of opposite sign.

The main purposes for using series-inductive slot tuning of a filter resonator is to increase the RF power rating of the filter. This is because the amount of voltage stress applied to the diode when capacitive irises are used is relatively much greater than when inductive slots are used. For a given allowable RF voltage stress on a reverse-biased PIN diode the power rating of the filter can be a great deal higher when slots are used. The use of capacitive-type fine tuning irises along with slots for coarse-tuning does not affect the argument. Further, when slots are used, the requirement for bias chokes and related circuit components which are required with irises, are eliminated.

Furthermore, and alternatively, for a given RF power rating for the filter, the voltage stress on an individual reverse-biased PIN diode will be much less in a design based on series-inductive slots than in a design based on shunt-capacitive-irises. Thus, less expensive diodes can be used. Also, the generation of intermodulation distortion by the diode (because the capacitance $C_2$ in FIG. 1A is effectively somewhat non-linear) would be greatly reduced. (The reduction in voltage stress in a reverse-biased diode is accompanied by a corresponding increase in RF current stress, and accompanying thermal stress, when the diode is forward biased. However, PIN diodes have a capability for carrying RF currents at UHF that is so large that it rarely is attained, and if properly packaged with a heat sink, the thermal dissipation rating of suitable diodes is more than adequate.)

Accordingly, there has been described and shown hereinabove a novel and useful arrangement for enabling the tuning of a wave guide resonator.

I claim:

1. An electronically tunable waveguide resonator comprising:

walls defining an elongated waveguide resonator, each of a plurality of means forming an inductive slot at said walls, said plurality of means being spaced along said walls at predetermined locations, along the axis of said waveguide resonator and each slot being substantially an annular slot about the axis, and switch means for selectively shorting each of said plurality of means forming an inductive slot for altering the frequency tuning of said waveguide resonator.

2. An electronically tunable waveguide resonator comprising:

walls defining a waveguide resonator, each of a plurality of means forming an inductive slot at said walls, said plurality of means being spaced along said walls at predetermined locations along the axis of said waveguide resonator, and switch means for selectively shorting each of said plurality of means forming an inductive slot for altering the frequency tuning of said waveguide resonator, each of said plurality of means forming an inductive slot comprises a trench cut into the inner surface of said walls, and extending in a direction perpendicular to the axis of said waveguide resonator, said switch means comprises a plurality of diode means for each trench, each said plurality of diode means being disposed along a plurality of spaced locations along a trench and bridging the trench of each location, and means for biasing each said plurality of diode means to a conductive or non-conductive mode to short the inductance means formed by a trench when the diode means bridging a trench are in the conductive mode.

3. An electronically tunable waveguide resonator as recited in claim 2 wherein each of said plurality of diode means comprises a pair of diodes each having an anode and a cathode, means connecting the respective cathodes of each pair of diodes to opposite locations across the trench in the waveguide wall, means connecting the anodes of a plurality of diode means together, an opening through the walls defining said waveguide resonator adjacent the center of each trench, and means connecting each said means connecting the anodes of a plurality of diode means together to each said means for biasing through each said opening.

4. An electronically tunable waveguide resonator comprising:

walls defining a waveguide resonator, each of a plurality of means forming an inductive slot at said walls, said plurality of means being spaced along said walls at predetermined locations along the axis of said waveguide resonator, and switch means for selectively shorting each of said plurality of means forming an inductive slot for altering the frequency tuning of said waveguide resonator, each of said plurality of means forming an inductive slot comprises:

an elongated opening cut through the walls of said waveguide resonator and extending in a direction perpendicular to the axis of said waveguide, slot walls extending outwardly from said walls defining said waveguide resonator, said slot walls enclosing said elongated opening and defining a trench into which said opening serves as an entrance, said switch means comprising a plurality of diode means for each elongated opening disposed over a plurality of locations along the elongated opening and bridging said opening at each location, and means for biasing each said plurality of diode means to a conductive or non-conductive mode to short the inductance means formed by said slot walls when the diode means bridging an elongated opening are in the conductive mode.

5. An electronically tunable waveguide as recited in claim 4 wherein each of said plurality of diode means comprises a pair of diodes each having an anode and a cathode, means connecting the respective cathodes of each pair of diodes to opposite locations across the elongated opening in the waveguide wall, means connecting the anodes of a plurality of diode means together, an opening through the walls defining said waveguide resonator adjacent the center of each elongated opening, and means connecting each said means connecting the anodes of a plurality of diode means together to each said means for biasing through each said opening.

6. An electronically tunable waveguide resonator as recited in claim 4 wherein said waveguide resonator has a length equal to one half wavelength of a desired frequency of operation, and to achieve binary tuning the locations of the trenches are at respective locations $l_1, l_2 \ldots l_N$, where $l_1, l_2 \ldots l_N$ are the distances from a current node of the unloaded waveguide, $l$ is the distance from a current node to a current antinode in the unloaded waveguide, N is an integer and the following relationship is satisfied at each location, $$2^{i-1}\sin^2 \frac{\pi l i}{2l} = 1$$

where $i = 1, 2, 3, \ldots, N$.

7. An electronically tunable waveguide resonator as recited in claim 5 wherein said waveguide resonator has a length equal to one half wavelength of a desired frequency of operation, and to achieve binary tuning the locations of the elongated openings are at respective locations $l_1, l_2 \ldots l_N$, where $l_1, l_2 \ldots l_N$ are the distances from a current node of the unloaded waveguide, $l$ is the distance from a current node to a current antinode in the unloaded waveguide, N is an integer, and the following relationship is satisfied at each location, $$2^{i-1}\sin^2 \frac{\pi l i}{2l} = 1$$

where $i = 1, 2, 3, \ldots, N$.

8. An electronically tunable waveguide resonator as recited in claim 4 wherein said tunable waveguide resonator has a length equal to one quarter wavelength at a desired frequency of operation, is a coaxial waveguide resonator, and is shorted at one end and open-circuited at the other end.

9. An electronically tunable waveguide resonator as recited in claim 5 wherein said tunable waveguide resonator has a length equal to one quarter wavelength at a desired frequency of operation, is a coaxial waveguide resonator, and is shorted at one end and open-circuited at the other end.

10. An electronically tunable waveguide resonator as recited in claim 4 wherein said electronically tunable waveguide resonator has a wavelength equal to one half wavelength at a desired frequency of operation, is a coaxial waveguide, and is short-circuited at both ends.

11. An electronically tunable waveguide resonator as recited in claim 5 wherein said electronically tunable waveguide resonator has a wavelength equal to one half wavelength at a desired frequency of operation, is a coaxial waveguide, and is short-circuited at both ends.

12. An electronically tunable waveguide as recited in claim 5 wherein said waveguide is a ridged rectangular waveguide.

13. An electronically tunable coaxial waveguide resonator having an outer cylindrical wall and a hollow central conductor, a plurality of trenches formed in the outer periphery of said central conductor, each trench extending at right angles to the axis of said waveguide around said central conductor, said trenches being spaced and positioned at predetermined locations along the length of said central conductor, a plurality of diode means for each trench, spaced therealong, and bridging each trench, means for selectively biasing each said plurality of diode means to a conductive or a non-conductive mode to short the inductance formed by a trench when in a conductive mode, and means for connecting said means for selectively biasing to each of said plurality of diodes through said hollow central conductor.

14. An electronically tunable rectangular-ridged waveguide resonator having rectangular walls defining a rectangular space and a ridge extending into said space from one wall, a plurality of trenches formed on the convex surface of said ridge, each trench extending at right angles to the axis of said waveguide, said trenches being spaced at predetermined locations along said ridge length, a plurality of diode means for each trench, spaced therealong and bridging each trench, and means for selectively biasing each said plurality of diode means to a conductive or non-conductive mode to short the inductance formed by said trench when in the conductive mode.

15. An electronically tunable waveguide resonator comprising:

a waveguide resonator having walls defining an elongated cavity and having a central conductor extending through said cavity, N trench means forming N inductive slots spaced along said walls, each said trench means forming an inductive slot extending along said walls at right angles to the axis of said waveguide resonator, said N trench means being positioned along said waveduide at locations as follows, $\sin^2 \pi l_1/2l = 2\sin^2 \pi l_2/2l = 4\sin^2 \pi l_3/2l = \ldots = 2^{N-1}\sin^2 \pi l_N/2l$, where each of $l_1, l_2, l_3 \ldots l_N$ is a location of a slot measured from a current node of the unloaded waveguide, $l$ is the distance from a current node to a current antinode in the unloaded waveguide, and N is an integer, a plurality of diode means for each trench means forming an inductive slot, spaced therealong and bridging each said trench means, and means for selectively biasing each said plurality of diode means to a conductive or non-conductive mode to short the inductance formed by said trench means when the plurality of diode means of said trench means are in the conductive mode.

* * * * *